US008514133B2

(12) United States Patent
Zhang

(10) Patent No.: US 8,514,133 B2
(45) Date of Patent: Aug. 20, 2013

(54) ANTENNA

(75) Inventor: Yi Fang Zhang, Guangdong (CN)

(73) Assignee: Yunnan Galaxy Star Technology Limited, Kunming (CN)

( * ) Notice: Subject to any disclaimer, the term of this patent is extended or adjusted under 35 U.S.C. 154(b) by 360 days.

(21) Appl. No.: 12/992,642

(22) PCT Filed: May 13, 2009

(86) PCT No.: PCT/CN2009/000519

§ 371 (c)(1),
(2), (4) Date: Nov. 15, 2010

(87) PCT Pub. No.: WO2009/137991

PCT Pub. Date: Nov. 19, 2009

(65) Prior Publication Data

US 2011/0063188 A1 Mar. 17, 2011

(30) Foreign Application Priority Data

May 16, 2008 (CN) ..... 2008 1 0097819

(51) Int. Cl.
*H01Q 1/36* (2006.01)

(52) U.S. Cl.
USPC ..... 343/700 MS; 343/895

(58) Field of Classification Search
USPC ..... 343/700 MS, 895
See application file for complete search history.

(56) References Cited

U.S. PATENT DOCUMENTS 5,621,422 A 4/1997 Wang
6,975,281 B2 * 12/2005 Neel ..... 343/895
7,388,543 B2 * 6/2008 Vance ..... 343/700 MS

FOREIGN PATENT DOCUMENTS

CN 1519986 A 8/2004
CN 1630962 A 6/2005
CN 1945898 A 4/2007

OTHER PUBLICATIONS

Form PCT/ISA/210, WO, Aug. 20, 2009, ISR for PCT/CN2009/000519.

* cited by examiner

*Primary Examiner* — Hoang V Nguyen
(74) *Attorney, Agent, or Firm* — Edwards Wildman Palmer LLP; Brian R. Landry

(57) ABSTRACT

An antenna comprises a first conductor, a second conductor and a third conductor each of which has a certain length and does not intersect with each other, wherein the third conductor is positioned between the first conductor and the second conductor, and an end of the first conductor electrically connects to an end of the second conductor, further forms a connection point connecting to the ground of radio frequency signal, an end of the third conductor which is adjacent to the connection point connects to a radio frequency signal line, the length of the first conductor is greater than that of the second conductor. The antenna of present invention is able to be mass-produced and has the advantages of small size, low cost, and large bandwidth.

10 Claims, 2 Drawing Sheets

ANTENNA

This application is the U.S. national phase, pursuant to 35 U.S.C. §371, of PCT international application Ser. No. PCT/CN2009/000519, filed May 13, 2009, designating the United States and published in Chinese on Nov. 19, 2009 as publication WO 2009/137991 A1, which claims priority to Chinese application Ser. No. 200810097819.9, filed May 16, 2008. The entire contents of the aforementioned patent applications are incorporated herein by this reference.

FIELD OF THE INVENTION

The present invention relates to an electronic component, and more particularly to a miniaturized and ultra-bandwidth antenna which is used for wireless communication.

BACKGROUND

Antenna is an essential key component of mobile communication products, the radiation efficiency, directivity, bandwidth, impedance matching characteristic, size and cost of which will have a great influence on communication products. At the same time, the requirements of miniaturization, diversity, legerity and beauty for communication products is making antenna design become an art incorporating the requirements of miniaturization, bandwidth, radiation efficiency and low-cost into it.

China patent CN1519986A discloses a microstrip antenna capable of increasing frequency bandwidth, which allows radio frequency signal to pass through paths of different length on two edges of one planar radiation sheet by using the planar radiation sheet and a gap opened at the input terminal of the radiation sheet, so as to attain an increased frequency bandwidth. It has the advantage of being easy-fabricated.

China patent CN1945898A discloses an ultra-bandwidth antenna, having two electromagnetic materials at the connection of its microstrip and radiation sheet so as to increase bandwidth.

Neither the above two patents satisfies the requirements of the frequency bandwidth for wireless mobile communication products in multiple system formats, and the size of the antenna is big relative to its installation size in a handheld device.

SUMMARY

To solve the existing problems, the present invention is directed to an antenna.

In one aspect, the technical solution of the present invention is as follows:

An antenna comprises a first conductor, a second conductor and a third conductor each of which has a certain length and does not intersect with each other, wherein the third conductor is positioned between the first conductor and the second conductor, and an end of the first conductor electrically connects to an end of the second conductor, further connects to ground of radio frequency signal to form a connection point, an end of the third conductor which is adjacent to the connection point connects to a radio frequency signal line, and the length of the first conductor is greater than that of the second conductor.

It is preferred for the antenna of the present invention that the first conductor, the second conductor and the third conductor all extend in straight line, curve, spiral or a combination of straight line and curve in a same direction within a same plane.

It is preferred for the antenna of the present invention that the first conductor, the second conductor and the third conductor are provided on dielectric material(s), and the syntheses dielectric constant of the dielectric material(s) between the first conductor and the third conductor is greater than or equal to that between the second conductor and the third conductor.

It is preferred for the antenna of the present invention that geometry shape of the extension of the spiral is circle, curve, polygon or any combination shape of them, the extension of the combination of straight line and curve is any combination shape of straight line, curve and polygon, and a feeding point of the radio frequency signal is on end-points, which are in the central position of the extension of the spiral, of the conductors.

It is preferred for the antenna of the present invention that the conductor is composed of an arrangement of a plurality of conductive materials.

It is preferred for the antenna of the present invention that the identical first conductor, the identical second conductor and the identical third conductor are formed on the other side of the dielectric material(s) in the manner of mirror image, and the first conductors on both sides of the dielectric material(s) are connected by metallized through hole(s), the second conductors on both sides of the dielectric material(s) are connected by metallized through hole(s), and the third conductors on both sides of the dielectric material(s) are connected by metallized through hole(s).

It is preferred for the antenna of the present invention that a gap which has a certain length is carved on the dielectric material(s) between the first conductor and the third conductor and/or between the second conductor and the third conductor.

It is preferred for the antenna of the present invention that dielectric material(s) with different dielectric constants are filled in the gap.

Another technical solution of the present invention is as follows:

An antenna comprises a first conductor and a second conductor each of which has a certain length and does not intersect with each other, wherein an end of the first conductor forms a connection point connecting to ground of radio frequency signal, an end of the second conductor which is adjacent to the connection point connects to a radio frequency signal line, the first conductor and the second conductor extend in straight line, curve, spiral or a combination of straight line and curve in a same direction within a same plane.

It is preferred for the antenna of the present invention that the first conductor and the second conductor are provided on dielectric material(s), and geometry shape of the extension of the spiral is circle, curve, polygon or any combination shape of them, the extension of the combination of straight line and curve is a combination of straight line with circle, curve or polygon.

It is preferred for the antenna of the present invention that the conductor is composed of an arrangement of a plurality of conductive materials.

It is preferred for the antenna of the present invention that the identical first conductor and the identical second conductor are formed on the other side of the dielectric material(s) in the manner of mirror image, and the first conductors on both sides of the dielectric material(s) are connected by metallized through hole(s), the second conductors on both sides of the dielectric material(s) are connected by metallized through hole(s).

The antenna of the present invention is of an ultra-bandwidth array antenna, the advantageous effects of which are as follows:

1. The radiation capability of electromagnetic wave is enhanced by taking advantage of the length difference between the first conductor and the second conductor, wherein the length of the first conductor is greater than that of the second conductor.

2. The ultra-bandwidth frequency response is further obtained by taking advantage of the arrangement that the syntheses dielectric constant of the dielectric material(s) between the first conductor and the third conductor is greater than that between the second conductor and the third conductor.

3. The volume of the antenna is reduced in size by spiraling three conductors having certain lengths on the dielectric material(s) in a spiral shape.

4. The circular polarization electromagnetic wave is further obtained by taking advantage of the spiral shape, and the performance of antenna is improved.

5. A thin and small-sized ultra-bandwidth antenna is obtained by taking advantage of said structure of planar spiral shape, and the contradiction between the antenna performance and the reduced size of the volume is solved at the same time.

6. The antenna of the present invention is apt to be produced by a printed circuit board process which has low production cost and is apt to mass production.

DESCRIPTION OF THE PREFERRED EMBODIMENTS

Figure 1:
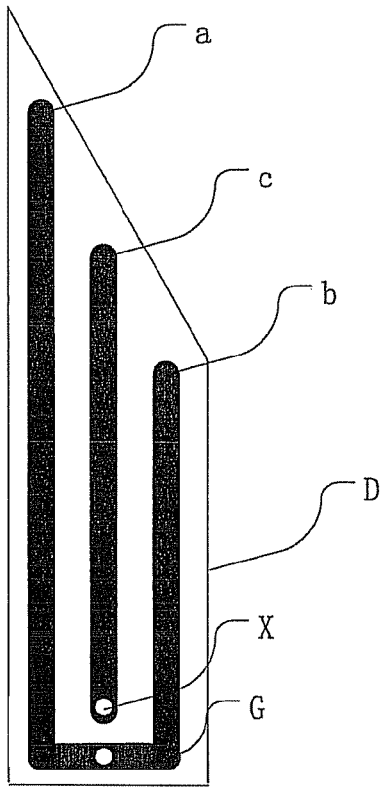
FIG. 1 is a schematic view of an antenna according to a first embodiment of the present invention.

Hereinafter, a further explanation will be made to the present invention with reference to the accompanying drawings and the preferred embodiments.

The embodiments of the antenna in the present invention may be embodied in various kinds of arrangements, but the principle of the antenna being constructed is consistent. Referring to the accompanying drawings, an antenna of the present invention comprises: conductor a, conductor b and conductor c, each of which has a certain length and does not intersect with each other.

Conductor c is positioned between conductor a and conductor b. The adjacent end of conductor a and conductor b electrically connects with each other, then connects to the ground of radio frequency signal so as to form a connection point, and the end of conductor c which is adjacent to the connection point connects to the radio frequency signal line. The length of conductor a is greater than that of conductor b, thereby enhancing the radiation of electromagnetic wave.

Preferably, conductor a, conductor b and conductor c which have the certain lengths are produced on dielectric material(s), and the syntheses dielectric constant of the dielectric material(s) between conductor a and conductor c is greater than or equal to that between conductor b and conductor c, accordingly the bandwidth is increased. The syntheses dielectric constant referred to in the present description means that in a certain region, if there is only one kind of dielectric material, the syntheses dielectric constant is the relative dielectric constant of the dielectric material, and if there are various kinds of dielectric materials, the syntheses dielectric constant is an arithmetic mean value of the relative dielectric constants of the respective dielectric materials.

Preferably, conductor a, conductor b and conductor c which have the certain lengths are spiraled on the dielectric material(s), and the length of conductor a is greater than that of conductor b, the lengths of conductor a and conductor c are greater than zero, the length of conductor b is greater than or equal to zero, thereby further reducing the volume in size. When the length of conductor b is equal to zero, that is, the antenna comprises a first conductor and a second conductor each of which has a certain length and does not intersect with each other, an end of the first conductor forms a connection point connecting to the ground of radio frequency signal, and an end of the second conductor which is adjacent to the connection point connects to the radio frequency signal line, and the first conductor and the second conductor extend in straight line, curve, spiral or a combination of straight line and curve in a same direction within a same plane. The first conductor and the second conductor are provided on dielectric material(s), and geometry shape of the extension of the spiral is circle, curve or polygon, or any combination shape of curve, circle and polygon, or the combination of the straight line with circle, curve or polygon.

Preferably, conductor a, conductor b and conductor c which have the certain lengths are spiraled on the dielectric material(s), the spiral shape of which may be circle, curve, polygon, or any combination shape of them, and the feeding point of the radio frequency signal is located on end-points, which are in the central position of the spiral, of the three conductors, thereby further obtaining the circular polarization electromagnetic wave.

Preferably, conductor c connecting to the signal line and its adjacent conductors a and b being at both sides of conductor c respectively and connecting to the ground, may be composed of an arrangement of a plurality of conductive materials, thereby further reducing the electrical loss.

Preferably, metallized through hole(s) is provided on conductor c connecting to the signal line and on its adjacent conductors a and b being at both sides of conductor c respectively and connecting to the ground, thereby increasing the radiation capability of electromagnetic wave.

An antenna according to the first embodiment of the present invention is illustrated in FIG. 1.

The antenna (FIG. 1) is composed of conducting wire c connecting to the radio frequency signal line (X), conducting wires a and b adjacent to conducting wire c and connecting to the ground (G), and dielectric material(s) (D). In conducting wires a and b connecting to the ground (G), a is longer, whereas b is shorter.

Figure 2:
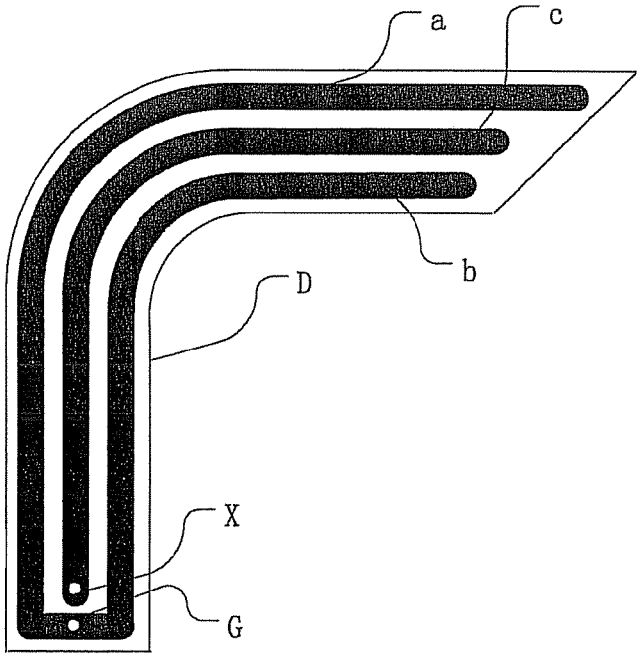
FIG. 2 is a schematic view of an antenna according to a second embodiment of the present invention.

An antenna according to the second embodiment of the present invention is illustrated in FIG. 2.

The antenna (FIG. 2) is composed of three curved conducting wires a, b and c (i.e. the combination of straight line and curve) and dielectric material(s) (D), conducting wire c connects to the radio frequency signal line (X) at the same side of conducting wires a, b and c, and the longer conducting wire a and the shorter conducting wire b which are adjacent to conducting wire c connect to the ground (G).

Figure 3:
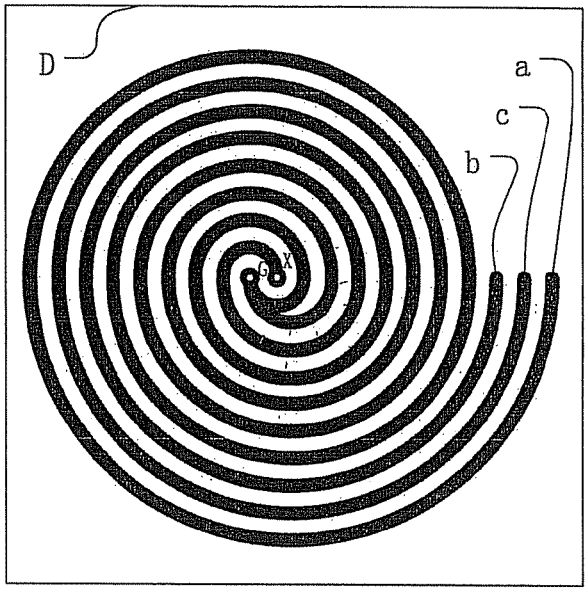
FIG. 3 is a schematic view of an antenna according to a third embodiment of the present invention.

An antenna according to the third embodiment of the present invention is illustrated in FIG. 3.

The antenna (FIG. 3) is composed of three conducting wires a, b and c spiraling on dielectric material(s) (D), one end of conducting wire c in the spiral centre of three conducting wires connects to the radio frequency signal line (X), and the longer conducting wire a and the shorter conducting wire b which are adjacent to conducting wire c connect to the ground (G). The length of conducting wire b may be zero.

Figure 4:
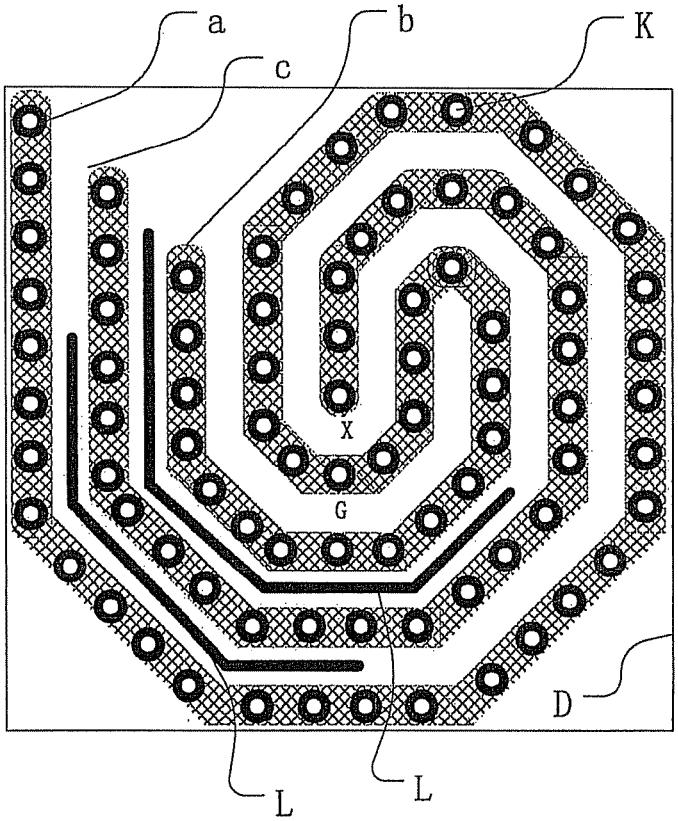
FIG. 4 is a schematic view of an antenna according to a fourth embodiment of the present invention.

An antenna according to the fourth embodiment of the present invention is illustrated in FIG. 4.

The antenna (FIG. 4) is composed of three conducting wires a, b and c spiraling on dielectric material(s) (D), the mirror image of three conducting wires on the other side of the dielectric is also composed of three identical conducting wires spiraling on the dielectric material(s), then the three pairs of conducting wires in each pair of which the conducting wire appears as mirror image to each other are connected by metallized through hole(s) (K) respectively to form three conductors. One end of conductor c in the spiral centre of three conductors connects to the radio frequency signal line (X), the longer conductor a and the shorter conductor b adjacent to conductor c connect to the ground (G), a gap (L) is carved between b and c and/or between a and c, or dielectric materials with different dielectric constants are filled between b and c and/or between a and c, such that the syntheses dielectric constant of the dielectric material(s) between a and c is greater than that of between b and c.

With the antenna in the above-mentioned preferred embodiments, improvement of electromagnetic wave radiation and frequency bandwidth of electromagnetic wave receiving is obtained, while enhancing radiation intensity and receiving sensitivity of electromagnetic wave by an appropriate increase in the length ratio of a to b.

For the antenna in the above-mentioned preferred embodiments, by means of the spiral structures of conducting wires a, b and c on the dielectric material(s), it is possible to select proper differences level between the syntheses dielectric constants between a and c and between b and c and proper spiral shapes, so as to satisfy the requirements of efficiency, cost, bandwidth, direction and volume in size for a variety of wireless communication products.

It is apparent from the above-mentioned preferred embodiments that the antenna of the present invention is simple in structure and in PCB production process, low in cost and apt to mass production.

The above embodiments are only the preferred embodiments of the present invention, which shall not be used to limit the protection scope of the present invention, therefore similarly all equivalents by using the contents of the description and accompanying drawings of the present invention should be included in the protection scope of the present invention.

What is claimed is:

1. An antenna, comprising a first conductor, a second conductor and a third conductor each of which has a certain length and does not intersect with each other, wherein the third conductor is positioned between the first conductor and the second conductor, and an end of the first conductor electrically connects to an end of the second conductor, further connects to ground of radio frequency signal to form a connection point, an end of the third conductor which is adjacent to the connection point connects to a radio frequency signal line, and the length of the first conductor is greater than that of the second conductor.

2. The antenna according to claim 1, wherein the conductor is composed of an arrangement of a plurality of conductive materials.

3. The antenna according to claim 1, wherein the first conductor, the second conductor and the third conductor all extend in straight line, curve, spiral, or a combination of straight line and curve, in a same direction within a same plane.

4. The antenna according to claim 3, wherein the first conductor, the second conductor and the third conductor are provided on dielectric material(s), and the syntheses dielectric constant of the dielectric material(s) between the first conductor and the third conductor is greater than or equal to that between the second conductor and the third conductor.

5. The antenna according to claim 4, wherein geometry shape of the extension of the spiral is circle, curve, polygon or any combination shape of them, the extension of the combination of straight line and curve is any combination shape of straight line, curve and polygon, and a feeding point of the radio frequency signal is on end-points, which are in the central position of the extension of the spiral, of the conductors.

6. The antenna according to claim 4, wherein the identical first conductor, the identical second conductor and the identical third conductor are formed on the other side of the dielectric material(s) in the manner of mirror image, and the first conductors on both sides of the dielectric material(s) are connected by metallized through hole(s), the second conductors on both sides of the dielectric material(s) are connected by metallized through hole(s), and the third conductors on both sides of the dielectric material(s) are connected by metallized through hole(s).

7. The antenna according to claim 4 or 6, wherein a gap which has a certain length is carved on the dielectric material(s) between the first conductor and the third conductor and/or between the second conductor and the third conductor.

8. The antenna according to claim 7, wherein dielectric material(s) with different dielectric constants are filled in the gap.

9. An antenna, comprising a first conductor and a second conductor each of which has a certain length and does not intersect with each other, wherein an end of the first conductor forms a connection point connecting to ground of radio frequency signal, an end of the second conductor which is adjacent to the connection point connects to a radio frequency signal line, the first conductor and the second conductor extend in straight line, curve, spiral or a combination of straight line and curve in a same direction within a same plane, and wherein the identical first conductor and the identical second conductor are formed on the other side of the dielectric material(s) in the manner of mirror image, and the first conductors on both sides of the dielectric material(s) are connected by metallized through hole(s), the second conductors on both sides of the dielectric material(s) are connected by metallized through hole(s).

10. An antenna, comprising a first conductor and a second conductor each of which has a certain length and does not intersect with each other, wherein an end of the first conductor forms a connection point connecting to ground of radio frequency signal, an end of the second conductor which is adjacent to the connection point connects to a radio frequency signal line, the first conductor and the second conductor extend in straight line, curve, spiral or a combination of straight line and curve in a same direction within a same plane, wherein the first conductor and the second conductor are provided on dielectric material(s), and geometry shape of the extension of the spiral is circle, curve, polygon or any combination shape of them, the extension of the combination of straight line and curve is the combination of straight line with circle, curve or polygon, and wherein the identical first conductor and the identical second conductor are formed on the other side of the dielectric material(s) in the manner of mirror image, and the first conductors on both sides of the dielectric material(s) are connected by metallized through hole(s), the second conductors on both sides of the dielectric material(s) are connected by metallized through hole(s).

* * * * *